US006170944B1

(12) United States Patent
Romano, Jr. et al.

(10) Patent No.: US 6,170,944 B1
(45) **Date of Patent: *Jan. 9, 2001**

(54) INK JET PRINTING PROCESS

(75) Inventors: Charles E. Romano, Jr., Rochester; Elizabeth A. Gallo, Penfield, both of NY (US)

(73) Assignee: Eastman Kodak Company, Rochester, NY (US)

( * ) Notice: Under 35 U.S.C. 154(b), the term of this patent shall be extended for 0 days.

This patent is subject to a terminal disclaimer.

(21) Appl. No.: 09/215,711

(22) Filed: Dec. 18, 1998

(51) Int. Cl.[7] ..... B41J 2/01

(52) U.S. Cl. ..... 347/101; 347/105; 427/337; 427/258

(58) Field of Search ..... 347/96, 98, 101, 347/105, 106; 427/421, 258, 261, 265, 337, 340, 343

(56) References Cited

U.S. PATENT DOCUMENTS

| | | | | |
|---|---|---|---|---|
| 4,419,388 | | 12/1983 | Sugiyama et al. | 427/288 |
| 5,474,843 | * | 12/1995 | Lambert et al. | 428/327 |
| 6,045,219 | * | 4/2000 | Erdtmann et al. | 347/101 |

FOREIGN PATENT DOCUMENTS

| | | |
|---|---|---|
| 2 324 800 | 4/1997 | (GB) . |
| 53123466 | 9/1980 | (JP) . |
| 10-219157 | 8/1998 | (JP) . |
| WO 95/28285 | 10/1995 | (WO) . |

* cited by examiner

*Primary Examiner*—John S. Hilten
*Assistant Examiner*—Leslie J. Grohusky
(74) *Attorney, Agent, or Firm*—Harold E. Cole

(57) ABSTRACT

An ink jet printing process for improving the water-fastness of an ink jet image comprising:

a) providing an ink jet recording element comprising a support having thereon an image-recording layer comprising a cross-linkable gelatin and a mordant, b) applying liquid ink droplets of an anionic, water-soluble dye on the image-recording layer in an image-wise manner, and c) submerging the element in an aqueous solution of a hardener to cross-link the gelatin.

7 Claims, No Drawings

INK JET PRINTING PROCESS

CROSS REFERENCE TO RELATED APPLICATION

Reference is made to commonly-assigned copending U.S. patent application Ser. No. 09/216,531, filed Dec. 18, 1998, Docket 78773HEC entitled "Ink Jet Printing Process", of Gallo et al; and Copending U.S. patent application Ser. No. 09/216,558, filed Dec. 18, 1998, Docket 78798HEC entitled "Ink Jet Printing Process", of Romano, Jr. et al; and Copending U.S. patent application Ser. No. 09/216,149, filed Dec. 18, 1998, Docket 78799HEC entitled "Ink Jet Composition", of Romano, Jr., et al; and Copending U.S. patent application Ser. No. 09/216,653, filed Dec. 18, 1998, Docket 78815HEC entitled "Ink Jet Printing Process", of Kovacs et al; and Copending U.S. patent application Ser. No. 09/216,288, filed Dec. 18, 1998, Docket 78818HEC entitled "Ink Jet Printing Process", of Kovacs et al; and Copending U.S. patent application Ser. No. 09/216,350, filed Dec. 18, 1998, Docket 78819HEC entitled "Ink Jet Printing Process", of Kovacs et al; and Copending U.S. patent application Ser. No. 09/216,147, filed Dec. 18, 1998, Docket 78820HEC entitled "Ink Jet Ink Composition", of Kovacs et al; and Copending U.S. patent application Ser. No. 09/216,203, filed Dec. 18, 1998, Docket 78846HEC entitled "Ink Jet Printing Method", of Romano, Jr., et al; and Copending U.S. patent application Ser. No. 09/216,304, filed Dec. 18, 1998, Docket 78847HEC entitled "Ink Jet Printing Method", of Kovacs et al; and Copending U.S. patent application Ser. No. 09/083,875, filed May 22, 1998, entitled "Inkjet Images on PVA Overcoated with Hardener Solution", of Erdtmann et al.; and Copending U.S. patent application Ser. No. 09/083,605 filed May 22, 1998, entitled "Ink Jet Prints Overcoated with Hardener", of Erdtmann et al., the teachings of which are incorporated herein by reference.

FIELD OF THE INVENTION

This invention relates to an ink jet printing process for improving the water-fastness of an ink jet image formed from an aqueous ink containing an anionic dye.

BACKGROUND OF THE INVENTION

Ink jet printing is a non-impact method for producing images by the deposition of ink droplets in a pixel-by-pixel manner to an image-recording element in response to digital signals. There are various methods which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation. Ink jet printers have found broad applications across markets ranging from industrial labeling to short run printing to desktop document and pictorial imaging.

The inks used in the various ink jet printers can be classified as either dye-based or pigment-based. A dye is a colorant which is molecularly dispersed or solvated by a carrier medium. The carrier medium can be a liquid or a solid at room temperature. A commonly used carrier medium is water or a mixture of water and organic co-solvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor light-fastness. When water is used as the carrier medium, such inks also generally suffer from poor water-fastness.

DESCRIPTION OF RELATED ART

JP 10-219157 relates to an ink jet ink comprising an aqueous medium, a colorant and a very small amount of glutaraldehyde as a biocide.

There is a problem with using this ink, however, in that when it is printed on an image-recording element, the resultant image has poor water-fastness.

It is an object of this invention to provide an ink jet printing process for improving the water-fastness of an ink jet image formed from an aqueous ink containing an anionic dye. It is another object of this invention to provide an ink jet printing process wherein a hardener is applied to improve the water-fastness of the ink jet image. It is another object of the invention to provide an ink jet printing process where the laydown of the hardener can be applied non-imagewise to the entire element.

SUMMARY OF THE INVENTION

In accordance with the present invention, there is provided an ink jet printing process for improving the water-fastness of an ink jet image comprising:

a) providing an ink jet recording element comprising a support having thereon an image-recording layer comprising a cross-linkable gelatin and a mordant, b) applying liquid ink droplets of an anionic, water-soluble dye on the image-recording layer in an imagewise manner, and c) submerging the element in an aqueous solution of a hardener to cross-link the gelatin.

It was found that the water-fastness of the image is improved with this treatment with a hardener solution.

DETAILED DESCRIPTION OF THE INVENTION

This process offers an advantage over incorporating a hardener in an ink since the hardener can be applied in both imaged and non-imaged areas.

Any hardener can be used in the invention provided it cross-links the cross-linkable gelatin employed. Hardeners may be used at concentrations ranging from 0.10 to 5.0 weight percent of active ingredient in the aqueous solution, preferably 0.25 to 2.0 weight percent.

The aqueous hardener solution may also contain, if desired, co-solvents, humectants, surfactants, and other ingredients commonly added to ink jet inks.

Examples of hardeners that can be employed in the invention fall into several different classes such as the following (including mixtures thereof):

a) formaldehyde and compounds that contain two or more aldehyde functional groups such as the homologous series of dialdehydes ranging from glyoxal to adipaldehyde including succinaldehyde and glutaraldehyde; diglycolaldehyde; aromatic dialdehydes, etc.;

b) blocked hardeners (substances usually derived from the active hardener that release the active compound under appropriate conditions) such as substances that contain blocked aldehyde functional groups, such as tetrahydro-4-hydroxy-5-methyl-2(1H)-pyrimidinone polymers, polymers of the type having a glyoxal polyol reaction product consisting of 1 anhydroglucose unit: 2 glyoxal units, dimethoxylethanal-melarnine non-formaldehyde resins, 2,3-dihydroxy-1,4-dioxane, blocked dialdehydes and N-methylol compounds obtained from the condensation of formaldehyde with various aliphatic or cyclic amides, ureas, and nitrogen heterocycles;

c) active olefinic compounds having two or more olefinic bonds, especially unsubstituted vinyl groups, activated by adjacent electron withdrawing groups, such as divinyl ketone; resorcinol bis(vinylsulfonate); 4,6-bis (vinylsulfonyl)-m-xylene; bis(vinylsulfonylalkyl) ethers and amines; 1,3,5-tris(vinylsulfonyl) hexahydro-s-triazine; diacrylamide; 1,3-bis(acryloyl)urea; N,N'-bismaleimides; bisisomaleimides; bis(2-acetoxyethyl) ketone; 1,3,5-triacryloylhexahydro-s-triazine; and blocked active olefins of the type bis (2-acetoxyethyl) ketone and 3,8-dioxodecane-1,10-bis(pyridinium perchlorate) bis(vinyl sulfonylmethane), bis(vinyl sulfonylmethyl ether), and the like;

d) compounds that contain two or more amino groups such as ethylene diamine; and e) inorganic salts such as aluminum sulfate; potassium and ammonium alums of aluminum; ammonium zirconium carbonate; chromium salts such as chromium sulfate and chromium alum; and salts of titanium dioxide, zirconium dioxide, etc.

Specific examples of hardeners useful in the invention include the following:

Hardener 1: aluminum sulfate

Hardener 2: bis(vinyl sulfonylmethane) (Eastman Kodak Company)

Hardener 3: 2,3dihydroxy-1,4-dioxane (Aldrich Chemical Co.)

Hardener 4: ethylene diamine

Hardener 5: glyoxal

Hardener 6: bis(vinyl sulfonylmethyl ether) (Eastman Kodak Company)

Hardener 7: glutaraldehyde

Hardener 8: a glyoxal polyol reaction product consisting of 1 anhydroglucose unit:2 glyoxal units, SEQUAREZ® 755 (Sequa Chemicals, Inc.)

Hardener 9: a cyclic urea glyoxal condensate consisting of 1 cyclic urea unit: 1 glyoxal unit, SUNREZ® 700M (Sequa Chemicals, Inc.)

Hardener 10: dimethoxylethanal-melamine non-formaldehyde resin, Sequa CPD3086-100 (Sequa Chemicals, Inc)

Any anionic, water-soluble dye may be used in the invention such as a dye having an anionic group, e.g., a sulfo group or a carboxylic group. The anionic dye may be any acid dye, direct dye or reactive dye listed in the COLOR INDEX but is not limited thereto. Metallized and non-metallized azo dyes may also be used as disclosed in U.S. Pat. No. 5,482,545, the disclosure of which is incorporated herein by reference. Other dyes which may be used are found in EP 802246-A 1 and JP 09/202043, the disclosures of which are incorporated herein by reference. In a preferred embodiment, the anionic, water-soluble dye which may be used in the invention is a metallized azo dye, a non-metallized azo dye, a xanthene dye, a metallophthalocyanine dye or a sulfur dye. Mixtures of these dyes may also be used. The dye may be present in an amount of from about 0.1 to about 10% by weight, preferably from about 0.25 to about 3% by weight.

Any mordant can be used in the invention provided it produces the desired result of fixing the anionic dye. For example, there may be used a cationic polymer, e.g., a polymeric quartenary ammonium compound, or a basic polymer, such as poly(dimethylaminoethyl)methacrylate, polyalkylenepolyamines, and products of the condensation thereof with dicyanodiamide, amine-epichlorohydrin polycondensates; divalent Group II metal ions; lecithin and phospholipid compounds. In a preferred embodiment of the invention, the following mordants are employed:

Mordant 1 vinylbenzyl trimethyl ammonium chloride/ethylene glycol dimethacrylate (Eastman Kodak Company)

Mordant 2 poly(vinylbenzyl trimethylammonium chloride) SP2 707 (SP2 Company)

Mordant 3 poly(2-N,N,N-trimethylammonium)ethyl methacrylate methosulfate (Eastman Kodak Company)

Mordant 4 poly(3-N,N,N-trimethylammonium)propyl methacrylate chloride, Polycare® 133 (Rhone-Poulenc Co.)

Mordant 5 poly(diallyldimethyl ammonium chloride) (Aldrich Chemical Co.)

Mordant 6 cationic polyethylene polyamine resin, Niccajet®117 (Nicca-USA)

Mordant 7 amine and glycidyl polymer, Niccajet® 450, (Nicca-USA)

Mordant 8 hydroxyethylcellulose derivitized with (3-N,N,N-trimethylammonium) propyl chloride, Celquat® SC-240C (National Starch Co.)

Mordant 9 alumina coated colloidal silica, Ludox® CL (DuPont)

Mordant 10 copolymer of vinylbenzyltrimethylammonium chloride, butyl acrylate, and bis-vinylbenzene in a 50:30:20 ratio (Eastman Kodak Company)

The mordant used in the invention may be employed in any amount effective for the intended purpose. In general, good results are obtained when the mordant is present in an amount of from about 0.5 to about 5 $g/m^2$.

The cross-linkable gelatin useful in the invention can be the conventional lime-processed ossein, acid-processed ossein or pig skin gelatin. In addition, there are a variety of chemically-modified gelatins formed by reacting the amino group of lysine which can be used. Some functional groups that have been added to gelatin include: phthalate, phenylcarbamyl, succinyl, carbamyl, lauryl, and dodecenyl succinyl. There can also be used quaternized gel, silanol modified gel, and graft copolymers of gel with poly(styrene sulfonate), poly(vinylpyrrolidone), and poly(methacrylic acid).

The image-recording layer used in the process of the present invention can also contain various known additives, including matting agents such as titanium dioxide, zinc oxide, silica and polymeric beads such as crosslinked poly (methyl methacrylate) or polystyrene beads for the purposes of contributing to the non-blocking characteristics and to control the smudge resistance thereof; surfactants such as non-ionic, hydrocarbon or fluorocarbon surfactants or cationic surfactants, such as quaternary ammonium salts; fluorescent dyes; pH controllers; anti-foaming agents; lubricants; preservatives; viscosity modifiers; dye-fixing agents; waterproofing agents; dispersing agents; UV-absorbing agents; mildew-proofing agents; mordants; antistatic agents, anti-oxidants, optical brighteners, and the like.

Ink jet inks used in the process of the present invention are well-known in the art. The ink compositions used in ink jet printing typically are liquid compositions comprising a solvent or carrier liquid, dyes, humectants, organic solvents, detergents, thickeners, preservatives, conductivity enhancing agents, anti-kogation agents, drying agents, defoamers, etc. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols.

A carrier can be present in the ink jet ink and can vary widely, depending on the nature of the ink jet printer for which the inks are intended. For printers which use aqueous inks, water, or a mixture of water with miscible organic co-solvents, is the preferred carrier medium. Co-solvents (0–20wt. % of the ink) are added to help prevent the ink from drying out or crusting in the orifices of the printhead or to help the ink penetrate the receiving substrate. Preferred co-solvents for the inks employed in the present invention include glycerol, ethylene glycol, propylene glycol, 2-methyl-2,4-pentanediol, and diethylene glycol, and mixtures thereof, at overall concentrations ranging from 5 to 20 wt. % of the ink.

The support for the ink jet recording element used in the invention can be any of those usually used for ink jet receivers, such as paper, resin-coated paper, poly(ethylene terephthalate), poly(ethylene naphthalate) and microporous materials such as poly polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861.

The support used in the invention may have a thickness of from about 50 to about 500 $\mu$, preferably from about 75 to 300 $\mu$. Antioxidants, antistatic agents, plasticizers and other known additives may be incorporated into the support, if desired. In a preferred embodiment, paper is employed.

In order to improve the adhesion of the image-recording layer to the support, the surface of the support may be subjected to a corona-discharge-treatment prior to applying the image-recording layer.

In addition, a subbing layer, such as a layer formed from a halogenated phenol or a partially hydrolyzed vinyl chloride-vinyl acetate copolymer can be applied to the surface of the support to increase adhesion of the image recording layer. If a subbing layer is used, it should have a thickness (i.e., a dry coat thickness) of less than about 2 $\mu$.

The image-recording layer may be present in any amount which is effective for the intended purpose. In general, good results are obtained when it is present in an amount of from about 5 to about 30 g/m$^2$, preferably from about 8 to about 15 g/m$^2$, which corresponds to a dry thickness of about 5 to about 30 $\mu$, preferably about 8 to about 15 $\mu$.

The following examples are provided to illustrate the invention.

EXAMPLES

Example 1

A photographic grade, polyethylene resin-coated paper was given a corona discharge treatment and then coated with an imaging layer of 7.7 g/m$^2$ of lime-processed bone gelatin (Eastman Kodak Company) and 0.9 g/m$^2$ of a mordant as indicated in Table 1. The coatings were applied using a extrusion hopper and air dried.

A Hewlett-Packard ink cartridge (HP 51649A) containing cyan anionic dyes was obtained. The cyan ink contained a mixture of Direct Blue 199 and Acid Blue 9 (6:1 by weight). This ink is described in U.S. Pat. No. 5,536,306, the disclosure of which is incorporated herein by reference.

A cyan patch was then printed on the receivers at 100% laydown using a Hewlett-Packard Printer (HP690C) and the above cartridge.

All the receiving elements, except for a control, were submerged in a bath containing a hardener solution containing 1 wt. % of the hardener identified in Table 1 and allowed to air dry overnight.

The optical density of the elements was measured using an X-Rite® densitometer. The elements were then immersed in distilled water. After 30 minutes, a portion of the element was rubbed vigorously about 7 times with a finger. After an hour, the elements were removed and then allowed to air dry overnight and the density remeasured. Water-fastness is measured as the per cent retained optical density after immersion in water. Values closest to 100% are preferred. Values over 100% indicate an undesirable "dot spread". The following results were obtained:

TABLE 1

| Element with | | % Retained Optical Density After | |
|---|---|---|---|
| Mordant | Hardener in Bath | Water Test | Rub Test |
| 1 | None | 136 | 44 |
| 1 | 1 | 115 | 130 |
| 1 | 2 | 102 | 117 |
| 1 | 3 | 111 | 101 |
| 1 | 4 | 106 | 98 |
| 1 | 5 | 114 | 105 |
| 2 | None | 141 | 112 |
| 2 | 1 | 107 | 126 |
| 2 | 2 | 104 | 97 |
| 2 | 3 | 110 | 94 |
| 2 | 4 | 112 | 93 |
| 2 | 5 | 107 | 109 |
| 3 | None | 160 | 96 |
| 3 | 1 | 101 | 151 |
| 3 | 2 | 102 | 94 |
| 3 | 3 | 111 | 95 |
| 3 | 4 | 108 | 101 |
| 3 | 5 | 114 | 104 |
| 4 | None | 162 | 107 |
| 4 | 1 | 95 | 148 |
| 4 | 2 | 99 | 89 |
| 4 | 3 | 108 | 93 |
| 4 | 4 | 107 | 102 |
| 4 | 5 | 99 | 99 |
| 5 | None | 151 | 94 |
| 5 | 1 | 89 | 141 |
| 5 | 2 | 92 | 82 |
| 5 | 3 | 97 | 90 |
| 5 | 4 | 96 | 90 |
| 5 | 5 | 96 | 90 |
| 6 | None | 128 | 89 |
| 6 | 1 | 93 | 114 |
| 6 | 2 | 95 | 83 |
| 6 | 3 | 96 | 91 |
| 6 | 4 | 79 | 75 |
| 6 | 5 | 99 | 62 |
| 2 | None | 155 | 116 |
| 2 | 5 (0.25%) | 107 | 110 |

TABLE 1-continued

| Element with | | % Retained Optical Density After | |
|---|---|---|---|
| Mordant | Hardener in Bath | Water Test | Rub Test |
| 2 | 5 (0.5%) | 99 | 108 |
| 2 | 5 (1%) | 115 | 118 |
| 2 | 5 (2%) | 111 | 125 |
| 2 | 5 (5%) | 111 | 121 |

The above data show that an ink jet image obtained in accordance with the invention has superior water-fastness (numbers closest to 100%) using one or both of the tests as compared to control elements not submerged in a hardener solution.

Example 2

Example 1 was repeated except that pig skin gelatin (Eastman Kodak Co.) was employed instead of lime-processed bone gelatin. The elements were tested as in Example 1 with the following results:

TABLE 2

| Element with | | % Retained Optical Density After | |
|---|---|---|---|
| Mordant | Hardener in Bath | Water Test | Rub Test |
| 7 | None | 110 | 184 |
| 7 | 1 | 113 | 102 |
| 7 | 2 | 105 | 97 |
| 7 | 3 | 106 | 98 |
| 7 | 4 | 98 | 94 |
| 7 | 5 | 114 | 112 |
| 8 | None | 171 | 166 |
| 8 | 1 | 109 | 106 |
| 8 | 2 | 108 | 106 |
| 8 | 3 | 108 | 105 |
| 8 | 4 | 63 | 62 |
| 8 | 5 | 104 | 100 |
| 9 | None | 124 | 110 |
| 9 | 1 | 87 | 85 |
| 9 | 2 | 90 | 98 |
| 9 | 3 | 96 | 96 |
| 9 | 4 | 89 | 91 |
| 9 | 5 | 98 | 97 |

The above data show that an ink jet image obtained in accordance with the invention has superior water-fastness (numbers closest to 100%) in one or both of the tests as compared to control elements not submerged in a hardener solution.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing process for improving the water-fastness of an ink jet image comprising:

a) providing an ink jet recording element comprising a support having thereon an image-recording layer comprising a cross-linkable gelatin and a mordant, b) applying liquid ink droplets of an anionic, water-soluble dye on said image-recording layer in an image-wise manner, and c) submerging said element in an aqueous solution of a hardener to cross-link said gelatin.

2. The process of claim 1 wherein said support is paper.

3. The process of claim 1 wherein said cross-linkable gelatin is present in an amount of from about 5 to about 30 $g/m^2$.

4. The process of claim 1 wherein said mordant is a cationic mordant or a basic polymer.

5. The process of claim 1 wherein said mordant is present in an amount of from about 0.5 to about 5 $g/m^2$.

6. The process of claim 1 wherein said anionic dye is a metallized or non-metallized azo dye, a xanthene dye, a metallophthalocyanine dye or a sulfur dye.

7. The process of claim 1 wherein said liquid ink droplets have a water carrier.

* * * * *